United States Patent [19]

Beaver et al.

[11] Patent Number: 4,877,499

[45] Date of Patent: Oct. 31, 1989

[54] MEMBRANE UNIT FOR ELECTROLYTIC CELL

[75] Inventors: Richard N. Beaver, Angleton, Tex.; Gregory J. E. Morris, Milan, Italy

[73] Assignee: The Dow Chemical Company, Midland, Mich.

[21] Appl. No.: 249,546

[22] Filed: Sep. 26, 1988

Related U.S. Application Data

[63] Continuation-in-part of Ser. No. 860,703, Jun. 5, 1986, which is a continuation of Ser. No. 668,043, Nov. 15, 1984, abandoned.

[51] Int. Cl.[4] ..... C25B 1/16; C25B 1/24; C25B 9/00

[52] U.S. Cl. ..... 204/98; 204/128; 204/252; 204/253; 204/296

[58] Field of Search ..... 204/98, 128, 252, 253, 204/296

[56] References Cited

U.S. PATENT DOCUMENTS

| | | | |
|---|---|---|---|
| 1,721,407 | 7/1929 | Pechkranz . | |
| 2,306,160 | 12/1942 | Freyssinet | 288/6 |
| 2,867,575 | 1/1959 | DeJong | 204/296 |
| 3,378,480 | 4/1968 | Reishagen et al. | 204/257 |
| 3,857,773 | 12/1974 | DuBois et al. | 204/242 |
| 3,869,375 | 3/1975 | Ono et al. | 204/301 |
| 3,964,932 | 6/1976 | Oltman et al. | 136/111 |
| 4,013,535 | 3/1977 | White | 204/252 |
| 4,026,782 | 5/1977 | Bouy et al. | 204/254 |
| 4,076,609 | 2/1978 | Mas | 204/258 |
| 4,098,670 | 7/1978 | Custer et al. | 204/252 |
| 4,107,023 | 8/1978 | Mentz | 204/269 |
| 4,111,779 | 9/1978 | Seko et al. | 204/255 |
| 4,137,144 | 1/1979 | Kenney | 204/268 |
| 4,139,448 | 2/1979 | Wallace | 204/256 |
| 4,175,024 | 11/1979 | Darlington | 204/252 |
| 4,175,025 | 11/1979 | Creamer et al. | 204/253 |
| 4,188,464 | 2/1980 | Adams et al. | 429/210 |
| 4,191,627 | 3/1980 | Specht | 204/296 |
| 4,197,206 | 4/1980 | Karn | 210/321 A |
| 4,207,165 | 6/1980 | Mose et al. | 204/258 |
| 4,217,200 | 8/1980 | Kedem et al. | 204/301 |
| 4,219,394 | 8/1980 | Babinsky et al. | 204/98 |
| 4,253,932 | 3/1981 | Mose et al. | 204/253 |
| 4,268,372 | 5/1981 | Iijima et al. | 204/252 |
| 4,268,373 | 5/1981 | Iijima et al. | 204/252 |
| 4,274,928 | 6/1981 | Cunningham | 204/98 |
| 4,279,731 | 7/1981 | Pellegri | 204/254 |
| 4,313,812 | 2/1982 | Kircher | 204/253 |
| 4,316,790 | 2/1982 | Iijima et al. | 204/296 |
| 4,332,661 | 6/1982 | Ford et al. | 204/253 |
| 4,341,605 | 7/1982 | Solenberger | 204/98 |
| 4,342,460 | 8/1982 | Eng | 277/1 |
| 4,344,633 | 8/1982 | Niksa | 277/228 |
| 4,381,984 | 5/1983 | Kircher | 204/258 |
| 4,390,408 | 6/1983 | Kircher | 204/284 |

(List continued on next page.)

FOREIGN PATENT DOCUMENTS

| | | | |
|---|---|---|---|
| 0051380 | 5/1982 | European Pat. Off. . | |
| 0080288 | 11/1982 | European Pat. Off. . | |
| 0118973 | 1/1984 | European Pat. Off. . | |
| 2821983 | 11/1979 | Fed. Rep. of Germany . | |
| 53-63284 | 6/1978 | Japan . | |
| 53-146272 | 12/1978 | Japan . | |
| 0141580 | 11/1980 | Japan | 204/98 |
| 56-38484 | 4/1981 | Japan . | |
| 58-4926 | 1/1983 | Japan . | |
| 58-35272 | 8/1983 | Japan . | |
| 1082867 | 3/1984 | U.S.S.R. . | |
| 1078129 | 12/1964 | United Kingdom . | |
| 1192245 | 5/1970 | United Kingdom . | |
| 2013242 | 8/1979 | United Kingdom . | |

*Primary Examiner*—John F. Niebling
*Assistant Examiner*—Kathryn Gorgos

[57] ABSTRACT

A membrane unit for use in an electrolytic cell comprising a combination of a first layer of membrane material and a second layer including a sealing material and a metallic insert around only the gasket-bearing surface of the membrane material. Damage to the gasket-bearing surface of the membrane structure is minimized when the membrane unit is employed in, for example, electrolytic cells of the filter press-type.

28 Claims, 4 Drawing Sheets

U.S. PATENT DOCUMENTS

| | | | |
|---|---|---|---|
| 4,431,502 | 2/1984 | Ford | 204/252 |
| 4,441,977 | 4/1984 | Ford | 204/252 |
| 4,470,068 | 9/1984 | Warren | 277/164 |
| 4,488,946 | 12/1984 | Morris et al. | 204/98 |
| 4,490,231 | 12/1984 | Boulton | 204/263 |
| 4,493,759 | 1/1985 | Boulton et al. | 204/252 |
| 4,585,527 | 4/1986 | Northway et al. | 204/1 R |
| 4,604,331 | 8/1986 | Louis | 429/35 |
| 4,610,765 | 9/1986 | Beaver et al. | 204/128 |
| 4,623,599 | 11/1986 | Vourlis | 429/174 |
| 4,638,109 | 1/1986 | Ford | 204/253 |
| 4,648,953 | 3/1987 | Wardle et al. | 204/237 |
| 4,654,134 | 3/1987 | Morris et al. | 204/252 |
| 4,656,104 | 4/1987 | Tucholski | 429/185 |
| 4,721,555 | 1/1988 | Grosshandler | 204/252 |
| 4,738,905 | 4/1988 | Collins | 429/36 |
| 4,748,092 | 5/1988 | Hekal | 429/35 |

MEMBRANE UNIT FOR ELECTROLYTIC CELL

Cross Reference to Related Applications

This is a continuation-in-part of copending application Ser. No. 860,703, filed June 5, 1986, which is a continuation of application Ser. No. 668,043, filed Nov. 15, 1984, now abandoned, all of which are herein incorporated by reference.

BACKGROUND OF THE INVENTION

This invention relates to membranes and, more particularly, this invention relates to a membrane unit for use in electrolytic cells.

There are many well-known membranes for use in electrolytic cells. For example, typical membranes include the perfluorinated carboxylic or sulfonic cation exchange membranes such as Nafion® manufactured by E. I. duPont de Nemours and Company or Flemion® manufactured by Asahi Glass Company, Ltd. These membranes are typically available in sheet form and employed in filter press-type or flat plate-type electrolytic cells having monopolar or bipolar electrodes.

Examples of bipolar, filter press-type cells are described in U.S. Pat. Nos. 4,111,779 and 4,108,742. These cells are used, for example, to carry out electrolysis of an aqueous alkali metal halide to produce a halogen, for example chlorine, and an alkalimetal hydroxide such as sodium hydroxide. Generally, the bipolar, filter press-type electrolytic cell is composed of several bipolar unit cells arranged in series. One bipolar unit cell has an anode and cathode compartment separated by a partition wall. Typically, the anode and cathode are attached to opposite sides of the partition wall. The membrane is usually interposed between two adjacent unit cells to separate the anode compartment from the cathode compartment. A plurality of anode and cathode frames are installed in a parallel fashion and a longitudinal compressive, usually by a clamping means, is applied to the anode and cathode frames with the membrane interposed between the frames to form the electrolytic cell in toto.

It is common practice to interpose a gasket between the membrane and the anode or cathode frame to provide the electrolytic cell with fluid-tight, i.e., a liquid- and gas-tight seal to prevent leakage of electrolyte between anode and cathode compartments or to the atmosphere. It is important to have a complete liquid- and gas-tight seal in electrolytic cells because these cells typically operate under corrosive environments. Generally, one side of the gasket is in contact with the lateral face of an electrode frame and the other side of the gasket is in contact with one side of the membrane's peripheral surface.

Typical gasket materials include resilient material such as rubber or an elastomer. Commercial bipolar membrane electrolyzers generally use ethylenepropylene (EPM) or ethylene-propylene-diene (EPDM) as gasket material between the membrane and electrode frames. These materials tend to deform and expand outwardly as pressure is applied to the frames via the frame members. As the gaskets deform outwardly, certain membranes which are in contact with the gaskets tend to stretch when they are pulled under the pressure of the outwardly deforming gaskets. This stretching of the membrane beneath the gaskets employed on adjacent electrode frames can cause the membranes to break or tear when attempting to compress the frames into a fluid-tight cell.

Any tears or breaks in the membranes may reduce current efficiency during operation, greatly increasing electrical current usage while reducing the electrolytic operating efficiency of the cell. Too great a drop in current efficiency and/or electrolytic operating efficiency can require costly shutdown of the entire cell while the damaged membrane or membranes are replaced.

It is desired to provide a membrane unit which will resist tearing upon application of a compressive force to the membranes gasket bearing surface.

SUMMARY OF THE INVENTION

The present invention is directed to an ion exchange membrane unit comprising at least a first layer of a first material adapted for use as an ion exchange membrane and at least a second layer including a metallic insert secured to the second layer, said second layer adapted for protecting the membrane from tearing or shear stresses when the membrane is under a compressive force. The second layer is secured to at least one side of the membrane around a gasket-bearing surface of the membrane.

BRIEF DESCRIPTION OF THE DRAWINGS

Although alternative embodiments of the present invention are shown in the following Figures, the same numerical system is used in the drawings to describe identical elements.

DETAILED DESCRIPTION OF THE PREFERRED EMBODIMENTS

Figure 1:
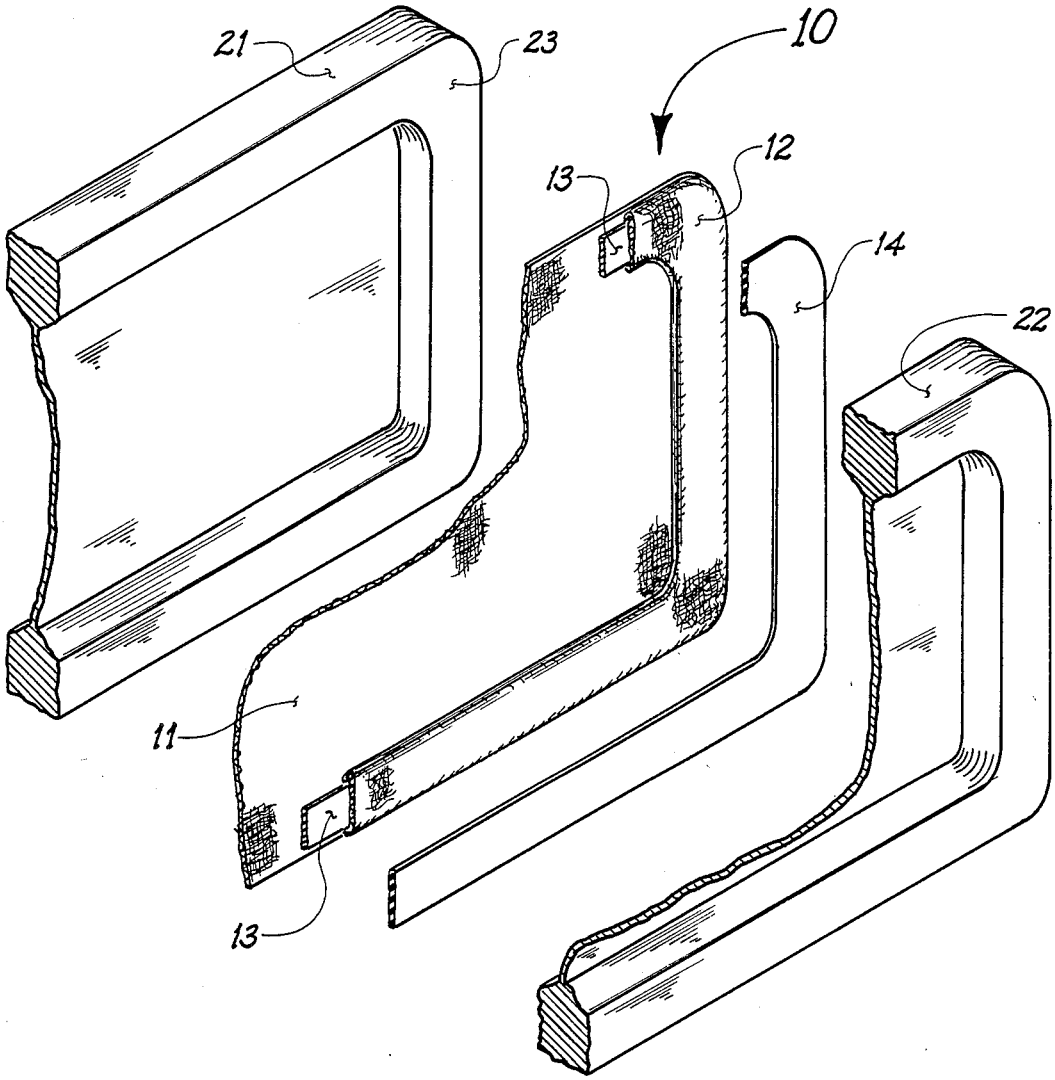
FIG. 1 is an exploded, partially broken away perspective view showing a membrane unit of the present invention and a gasket member interposed between two electrolysis cell frame members.
Figure 2:
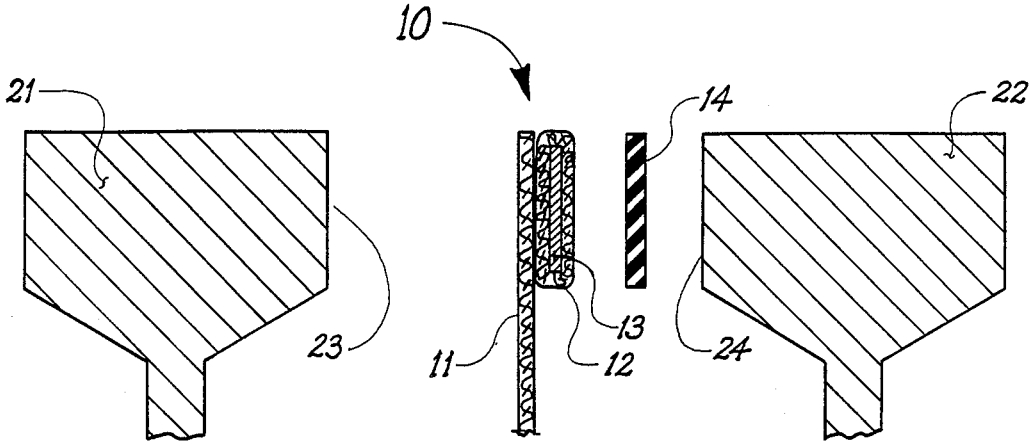
FIG. 2 is a cross-sectional view of the membrane unit showing FIG. 1.

The invention will now be described in conjunction with an embodiment thereof with reference to the accompanying drawings. Referring to FIGS. 1–8, there is shown a membrane unit, generally indicated by numeral 10. The membrane unit 10 includes a first layer consisting of a rectangular sheet 11 made of a membrane material with a second layer including a sealing material 12 and metallic insert 13 attached, bonded or otherwise adhered to at least a portion of the membrane material 11, and more specifically the second layer is securely attached to the peripheral edge or gasket-bearing surface of the membrane material 11. In this instance, the second layer includes the metallic insert 13 enclosed in the sealing material 12.

The membrane unit 10 is interposed between flange surfaces 23 and 24 of an electrolysis cell electrode frame members 21 and 22, respectively. A gasket member 14 may also be interposed between the membrane unit 10 and one or both of the frame members, in this instance, a gasket member 14 is interposed between the membrane unit 10 and frame member 22. FIGS. 1–4 show only one planar surface of the membrane 11 with sealing material 12 and having only one metallic reinforcement insert 13 secured to the sealing material 12. FIG. 5 is an alternate embodiment of the present invention in which the metallic insert 13 is embedded or enclosed in the membrane material 11. In this embodiment, a gasket 14 (not shown) is optional depending on the thickness of the membrane 11 around the gasket-bearing surface. FIGS. 6–7 show a sealing material 12 secured to both sides of the membrane 11 and having two metallic reinforcement inserts 14 and "Gasket-bearing surface" is defined herein as that portion of the periphery of the membrane material 11 subjected to compression forces in order to effect a seal at the periphery or flange surfaces 23 and 24 of the electrode frame members 21 and 22, respectively, of an electrolyzer. Typically, an electrolyzer electrode frame member is rectangular in shape and, thus, the second layer containing the metallic insert 13 has a picture-frame configuration or shape. However, it is to be understood that the structure of the membrane unit 11 of this invention is not limited to a rectangular sheet but can be circular or other desired shape.

The membrane material 11 can be made of any material conventionally used as a membrane for electrolyzers. Preferably, inert membranes having ion exchange properties and which are substantially impervious to the hydrodynamic flow of the electrolyte and the passage of gas products produced during electrolysis are used. Suitably used are cation exchange membranes such as those composed of fluorocarbon polymers having a plurality of pendant sulfonic acid groups or carboxylic acid groups or mixtures of sulfonic acid groups and carboxylic acid groups. The terms "sulfonic acid groups" and "carboxylic acid groups" are meant to include salts of sulfonic acid or salts of carboxylic acid which are suitably converted to or from the acid group by processes such as hydrolysis. An example of a carboxylic acid type cation exchange membrane is commercially available from Asahi Glass Company under the trademark Flemion®. Another example of a suitable membrane having cation exchange properties is a perfluorosulfonic acid membrane sold commercially by E. I. duPont de Nemours and Company under the trademark Nafion®.

The sealing material 12 can be made of any material suitable for strengthening the gasket bearing surface area of the membrane. The sealing material 12 can be of the same or different material as the membrane material 11. Preferably the sealing material 12 should have a heavier scrim than that of the membrane material. Both the membrane material 11 and the sealing material 12 should be made of a corrosion-resistant, non-contaminating material which is stable upon contact with electrolyte media present in an electrolytic cell. Suitable materials which can be employed in accordance with this invention include, but are not limited to, the following: Fluorine-containing polymers such as polytetrafluoroethylene (PTFE), fluorinated ethylene propylene copolymer (FEP) and perfluoroalkoxy resin (PFA): polysulfide polymers, polyvinyl chloride, fluoroelastomers such as Viton®, a trademark of E. I. duPont de Nemours and Company, and chlorosulfonated polyethylenes such as Hypalon®, a trademark of E. I. duPont de Nemours and Company.

The metallic insert 13 can be in the form of a wire mesh, woven wire, punched plate, metal sponge, expanded metal, perforated or unperforated metal sheet, flat or corrugated lattice works, spaced metal strips or rods and the like. As one example, the metallic insert may be a wire mesh with the wire having a diameter of from about 0.30 mm to about 0.5 mm.

The metallic insert 13 can be made from any metallic material suitable for reinforcing or strengthening the gasket-bearing surface area of the membrane 11. The metallic insert 13 should be made of a corrosion-resistant, non-contaminating material which is stable upon contact with electrolyte media present in an electrolytic cell. The metallic material used for insert 13 may depend on whether it is mounted on the anode or cathode side of the membrane 11. For example, metallic insert 13 materials can be selected from the group consisting of nickel, nickel alloys, stainless steel, iridium, tungsten, chromium, magnesium, tantalum, cadmium, zirconium, zinc, vanadium, molybdenum, copper, iron, lead, cobalt and alloys for the cathode side of the membrane. Metallic inserts 13 for the anode side can be selected from the group consisting of titanium, titanium alloys, tantalum, tantalum alloys, hafnium, hafnium alloys, niobium, niobium alloys, zirconium and zirconium alloys.

The sealing material 12 and metallic insert 13 can be attached or otherwise secured to the membrane 11 by any well known method in the art, for example, bonding with an adhesive, heat sealing, or ultrasonic sealing. The metallic insert 13 can also be inserted into the membrane during fabrication of the membrane material 11. It is preferred to bond the metallic insert 13 by heat sealing with a sealing material similar to that of the membrane.

Figure 3:
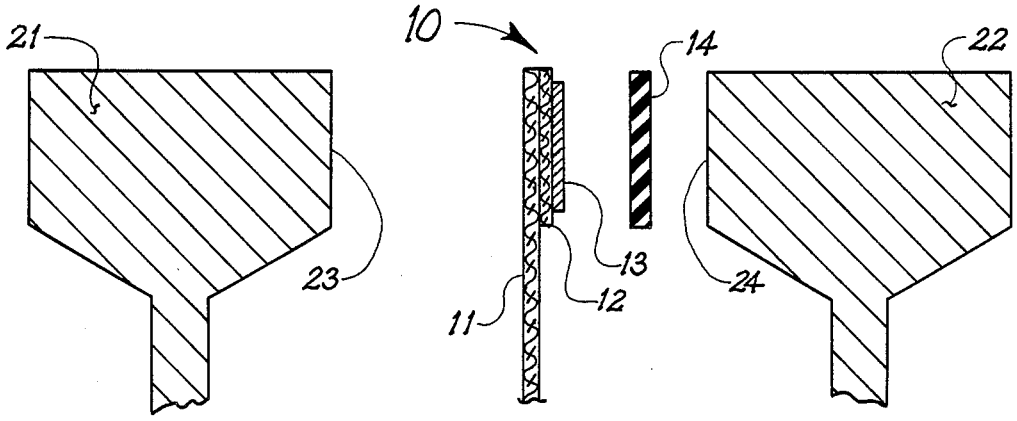
FIG. 3 is a cross-sectional view showing an alternate embodiment of a membrane unit of the present invention.
Figure 4:
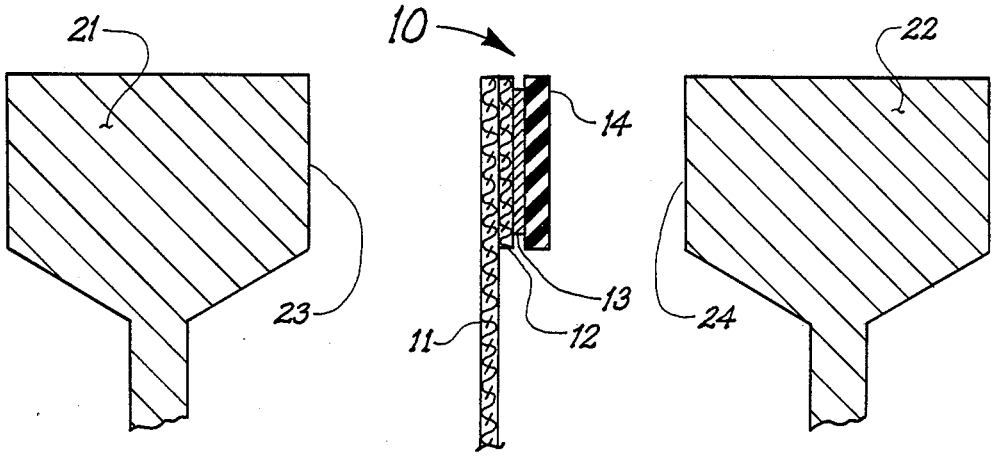
FIG. 4 is a cross-sectional view showing an alternate embodiment of a membrane unit of the present invention.
Figure 5:
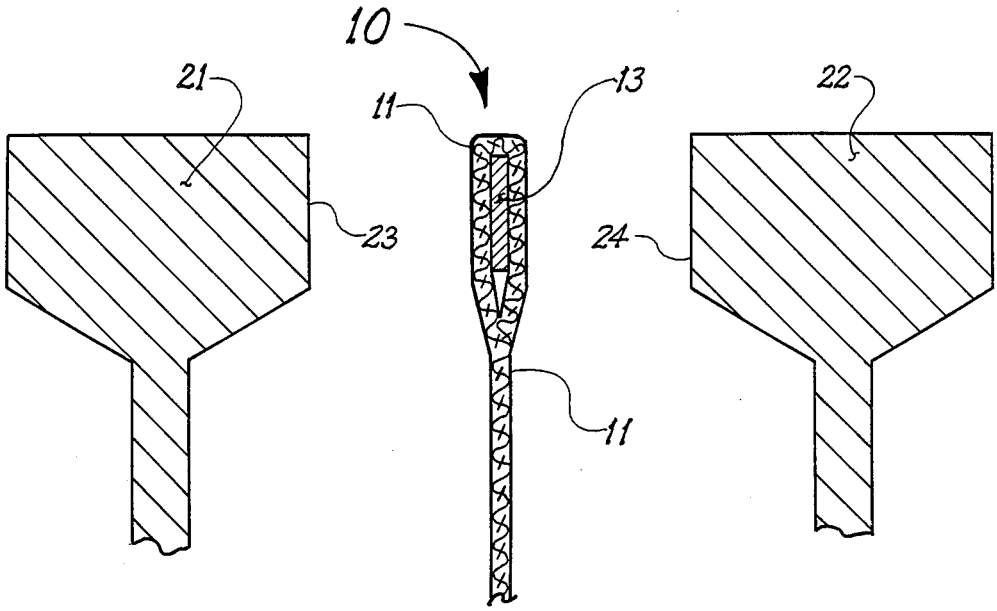
FIG. 5 is a cross-sectional view showing an alternate embodiment of a membrane unit of the present invention.
Figure 6:
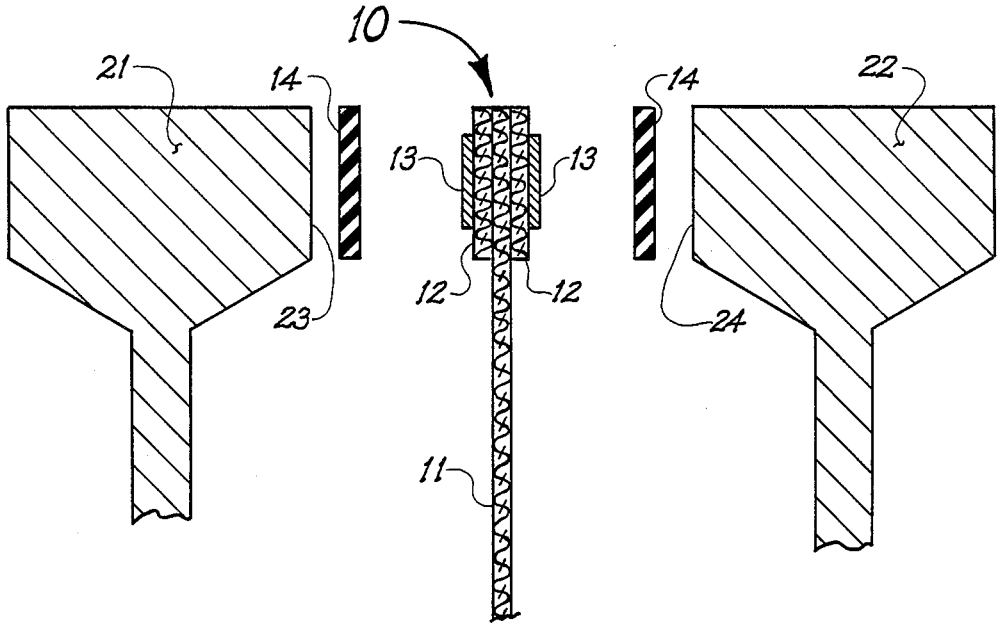
FIG. 6 is a cross-sectional view showing an alternate embodiment of a membrane unit of the present invention.
Figure 7:
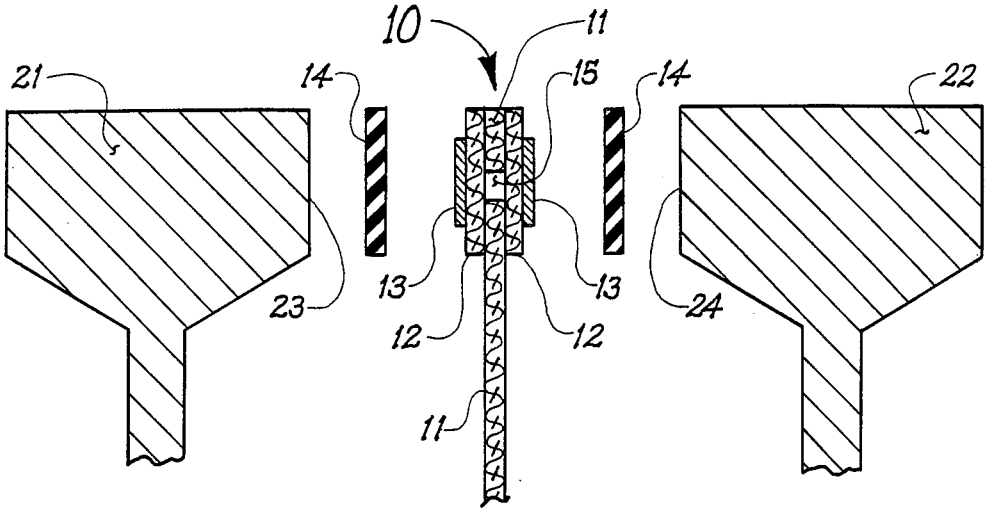
FIG. 7 is a cross-sectional view showing an alternate embodiment of a membrane unit of the present invention.

In FIGS. 3–7 there is shown alternate embodiments of the membrane unit 10. For example, the membrane unit may include a metallic insert 13 attached to one side of a sealing material 12 as shown in FIG. 3. In another embodiment, the membrane unit 10 may include a gasket member 14 in combination with the metallic insert 13 and the sealing material 12 attached to the membrane 11 as shown in FIG. 4.

In still another embodiment of the present invention, the metallic insert 13 may be enclosed or embedded in a membrane 11 at its gasket-bearing surface as shown in FIG. 5. While FIG. 5 does not show a gasket member 14, a gasket member may be interposed on either side of the membrane unit 10 and cell frame member 21 and/or 22. Alternatively, the thickness of the membrane material 11 on the gasket-bearing surface may be of sufficient thickness to provide a fluid-tight seal between the membrane and the cell frames 21 and 22 without the necessity of using gaskets.

In yet another embodiment of the present invention, the membrane unit 10 may comprise two metallic inserts 13 attached to two sealing materials 12 on each side of the membrane 11 as shown in FIG. 6. In this instance, gaskets 14 are arranged on each side of the membrane unit 10.

With reference to FIG. 7, there is shown a membrane unit 10 including two sealing members 12 and two metallic inserts 13. The membrane material 11, in this instance, contains perforations or openings 15 along its periphery or gasket-bearing surface. The metallic inserts 13 are secured to the gasket-bearing surface with the sealing materials 12 through the openings 15 on both sides of the membrane 11. A membrane material 11 having openings 15 such as shown in FIG. 7 allows for the sealing material 12 to bond through the membrane material 11 to secure the metallic inserts 13 on both sides through the openings 15. This is useful when bonding metallic inserts 13 with materials which are substantially difficult to attach to the membrane material 11. Generally, when the sealing material 12 and the membrane material 11 are made of dissimilar materials, the opening 15 should be used.

Figure 8:
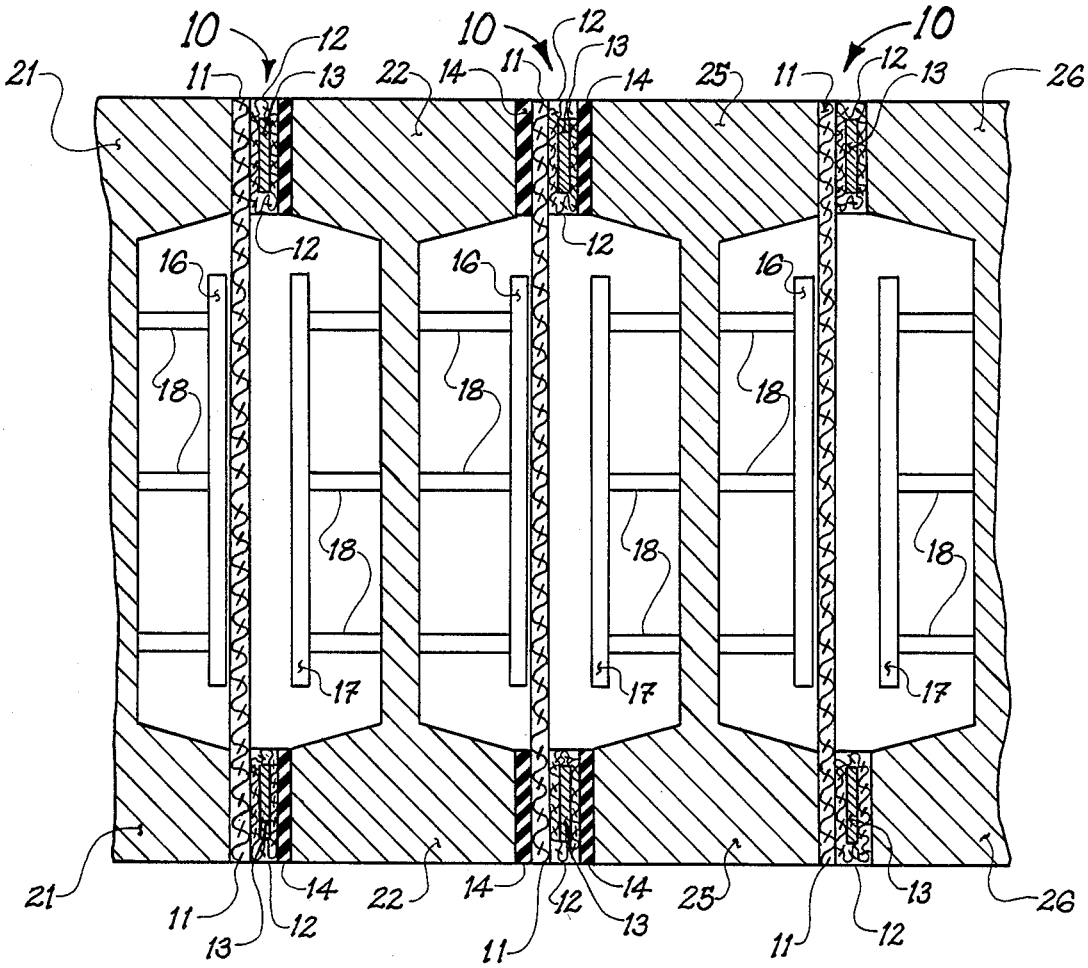
FIG. 8 is a cross-sectional view showing a portion of an electrolytic cell series assembly including a membrane unit of the present invention.

Referring to FIG. 8, an electrolysis cell assembly is shown with a membrane unit 10 (shown in FIGS. 1 and 2), interposed between electrode frame members 21, 22, 25 and 26, etc. Optionally, a gasket 14 may be interposed between the membrane unit 10 and electrode frame members. For example, between frame members 21 and 22 one gasket 14 is used, between frame members 22 and 25 two gaskets 14 are used and between frame members 25 and 26 no gasket member is used. If a gasket 14 is used in an electrolysis cell, the gasket 14 should be of a corrosion resistant material. The gasket should have a high volume resistivity and good sealability after it has been compressed. Suitable materials for the gasket 14 may be, for example, ethylene-propylene-diamonomer, a chlorinated polyethylene (CPE), a polytetrafluoroethylene such as Teflon®, manufactured by E. I. duPont de Nemours and Company, and reinforced asbestos.

The electrolysis cell assembly in FIG. 8 includes an anode 16 and a cathode 17 electrically connected with connectors 18 through the electrode frame members 21, 22, 25 and 26. The electrolysis cell assembly above is typical of bipolar electrolytic cells of the filter press-type such as described in U.S. Pat. Nos. 4,111,779 and 4,108,742. Any cell of the filter press-type may be used in the present invention including bipolar and monopolar type cells.

In order to effect sealing of the periphery of the electrode frame members 21 and 22, the membrane structure 10 and, preferably, a gasket 14 are interposed between two adjacent electrode frame members, such as frame members 21 and 22, and then a compressive force is applied to the cell assembly. The compressive force may be applied by any known means to those skilled in the art, for example, by clamping the frames together with tie-rods or by using a hydraulic ram The second layer comprising the sealing material 12 and metallic insert 13 advantageously protect the membrane 11 around its gasket-bearing surface from tearing or shear stresses which may be caused by the compressive forces applied to the membrane.

What is claimed is:

1. An ion exchange membrane unit for an electrolyzer of the filter press-type comprising:

(a) at least one sheet of an ion exchange membrane having a gasket-bearing surface portion and an active surface portion;

(b) at least one first non-gasket, non-frame means for strengthening the gasket-bearing surface portion of the membrane such that tearing or shear stresses on the gasket-bearing surface portion of the membrane is minimized when the gasket-bearing surface portion of the membrane is under a compressive force; and (c) at least one second non-gasket, non-frame means for strengthening the gasket-bearing surface portion of the membrane such that tearing or shear stresses on the gasket-bearing surface portion of the membrane is minimized when the gasket-bearing surface portion of the membrane is under a compressive force, said first and second strengthening means positioned only along the gasket-bearing surface portion of the membrane on at least one side of the membrane.

2. The membrane unit of claim 1 wherein the first strengthening means is a sealing material.

3. The membrane unit of claim 1 wherein the chemical composition of the sealing material is substantially of the same chemical composition as the membrane.

4. The membrane unit of claim 1 wherein the sheet of ion exchange membrane is composed of fluorocarbon polymers having a plurality of pendant sulfonic acid groups, carboxylic acid groups or mixtures of sulfonic acid groups and carboxylic acid groups.

5. The membrane unit of claim 1 wherein the sealing material is heat sealed to the membrane material.

6. The membrane unit of claim 1 wherein the sealing material is attached to the membrane material with an adhesive.

7. The membrane unit of claim 1 wherein the sealing material is bonded to the membrane material by high frequency welding.

8. The membrane unit of claim 1 wherein the membrane material has at least one opening and the sealing material is heat sealed to the membrane material through the opening.

9. The membrane unit of claim 1 wherein the sealing material is a tetrafluoroethylene fluorocarbon polymer material.

10. The membrane unit of claim 1 wherein the sealing material is attached to the membrane forming the cathode side.

11. The membrane unit of claim 1 wherein the sealing material attached to the membrane forming the anode side.

12. The membrane unit of claim 1 wherein the sealing material is substantially thick to be used as a gasket.

13. The membrane unit of claim 1 wherein the second strengthening means is a metallic material.

14. The membrane unit of claim 13 wherein the metallic material is selected from the group consisting essentially of wire mesh, woven wire, punched plate, metal sponge, expanded metal, perforated metal sheet, unperforated metal sheet, flat lattice, corrugated lattice, metal strips, or metal rods.

15. An electrolytic cell comprising a membrane separating at least two electrode compartments, said membrane comprising:

(a) at least one sheet of an ion exchange membrane having a gasket-bearing surface portion and an active surface portion;

(b) at least one first non-gasket, non-frame means for strengthening the gasket-bearing surface portion of the membrane such that tearing or shear stress on the gasket-bearing surface portion of the membrane is minimized when the gasket-bearing surface portion of the membrane is under a compressive force; and (c) at least one second non-gasket, non-frame means for strengthening the gasket-bearing surface portion of the membrane such that tearing or shear stresses on the gasket-bearing surface of the membrane is minimized when the gasket-bearing surface portion of the membrane is under a compressive force, said first and second strengthening means positioned only along the gasket-bearing surface portion of the membrane on at least one side of the membrane.

16. The cell of claim 15 wherein the first strengthening means is a sealing material.

17. The cell of claim 15 wherein the chemical composition of the sealing material is substantially of the same chemical composition as the membrane.

18. The cell of claim 15 wherein the sheet of ion exchange membrane is composed of composed of fluorocarbon polymers having a plurality of pendant sulfonic acid groups, carboxylic acid groups or mixtures of sulfonic acid groups and carboxylic acid groups.

19. The cell of claim 15 wherein the sealing material is heat sealed to the membrane material.

20. The cell of claim 15 wherein the sealing material is attached to the membrane material with an adhesive.

21. The cell of claim 15 wherein the sealing material is bonded to the membrane material by high frequency welding.

22. The cell of claim 15 wherein the membrane material has at least one opening and the sealing material is heat sealed to the membrane material through the opening.

23. The cell of claim 15 wherein the sealing material is a tetrafluoroethylene fluorocarbon polymer material.

24. The cell of claim 15 wherein the second strengthening means is a metallic material.

25. The cell of claim 24 wherein the metallic material is selected from the group consisting essentially of wire mesh, woven wire, punched plate, metal sponge, expanded metal, perforated metal sheet, unperforated metal sheet, flat lattice, corrugated lattice, metal strips, or metal rods.

26. A method of sealing an electrolytic cell comprising (a) interposing at least one gasket between at least one electrode frame and an ion exchange membrane unit in an electrolytic cell, said membrane unit comprising (i) at least one sheet of an ion exchange membrane having a gasket-bearing surface portion and an active surface portion;

(ii) at least one first non-gasket, non-frame means for strengthening the gasket-bearing surface portion of the membrane such that tearing or shear stresses on the gasket-bearing surface portion of the membrane is minimized when the gasket-bearing surface portion of the membrane is under a compressive force; and (iii) at least one second non-gasket, non-frame means for strengthening the gasket-bearing surface portion of the membrane such that tearing or shear stresses on the gasket-bearing surface portion of the membrane is minimized when the gasket-bearing surface portion of the membrane is under a compressive force, said first and second strengthening means positioned only along the gasket-bearing surface portion of the membrane on at least one side of the membrane; and (b) applying a compressive force to the cell.

27. A method of electrolysis comprising electrolyzing an alkali metal salt between a pair of electrodes separated by a membrane unit, said membrane unit comprising (i) at least one sheet of an ion exchange membrane having a gasket-bearing surface portion and an active surface portion;

(ii) at least one first non-gasket, non-frame means for strengthening the gasket-bearing surface portion of the membrane such that tearing or shear stresses on the gasket-bearing surface portion of the membrane is minimized when the gasket-bearing surface portion of the membrane is under a compressive force; and (iii) at least one second non-gasket, non-frame means for strengthening the gasket-bearing surface portion of the membrane such that tearing or shear stresses on the gasket-bearing surface portion of the membrane is minimized when the gasket-bearing surface portion of the membrane is under a compressive force, said first and second strengthening means positioned only along the gasket-bearing surface portion of the membrane on at least one side of the membrane.

28. An electrolytic cell assembly comprising:

(a) at least two adjacent electrode frame members;

(b) a membrane unit interposed between the electrode frame members; said membrane unit comprising (i) at least one sheet of an ion exchange membrane having a gasket-bearing surface portion and an active surface portion;

(ii) at least one first non-gasket, non-frame means for strengthening the gasket-bearing surface portion of the membrane such that tearing or shear stresses on the gasket-bearing surface portion of the membrane is minimized when the gasket-bearing surface portion of the membrane is under a compressive force; and (iii) at least one second non-gasket, non-frame means for strengthening the gasket-bearing surface portion of the membrane such that tearing or shear stresses on the gasket-bearing surface portion of the membrane is minimized when the gasket-bearing surface portion of the membrane is under a compressive force, said first and second strengthening means positioned only along the gasket-bearing surface portion of the membrane on at least one side of the membrane; and (c) a gasket interposed between at least one of the electrode frame members and the membrane unit.

* * * * *